United States Patent [19]

Hellerman et al.

[11] 4,040,265

[45] Aug. 9, 1977

[54] MOBILE OFFSHORE PLATFORM

[75] Inventors: Lance W. Hellerman; Richard S. Hollyer, both of Houston, Tex.

[73] Assignee: Marine Engineering Systems, Inc., Houston, Tex.

[21] Appl. No.: 655,682

[22] Filed: Feb. 6, 1976

[51] Int. Cl.[2] ..... E02B 17/04; B63C 1/00

[52] U.S. Cl. ..... 61/91; 61/98; 61/65

[58] Field of Search ..... 61/46.5, 72.3, 65

[56] References Cited

U.S. PATENT DOCUMENTS

| | | | |
|---|---|---|---|
| 2,907,172 | 10/1959 | Crake | 61/46.5 |
| 2,942,425 | 6/1960 | DeLong et al. | 61/46.5 |
| 2,970,447 | 2/1961 | Castille | 61/46.5 |
| 3,373,570 | 3/1968 | Hindman | 61/72.3 |
| 3,857,247 | 12/1974 | Phares | 61/46.5 |

*Primary Examiner*—Jacob Shapiro
*Attorney, Agent, or Firm*—Arnold, White & Durkee

[57] ABSTRACT

A mobile offshore platform in which a support structure receives interchangeable barges thereon for carrying out the different functions required in producing an offshore hydrocarbon reservoir. The mobile offshore platform includes a plurality of support legs extending into the water down to the ocean floor. Jacking mechanisms engage each support leg to raise and lower a negatively buoyant, open network platform structure relative to the surface of the water. A barge having a process plant installed on board is docked in position on the platform structure. A heave absorber disposed above the surface level of the platform structure engages the bottom of the barge to dampen vertical motion thereof. The platform structure and the barge are raised above the water to the required height, whereupon the platform structure is secured to the legs and the jacks may be removed for use on another platform. The mobile offshore platform is ideally suited for a mobile offshore processing plant which can be installed at the offshore well site to process hydrocarbons, particularly natural gas, into products which can be easily transported. Other uses include offshore exploration drilling, production drilling, production, well servicing and work over, and general construction uses.

8 Claims, 9 Drawing Figures

MOBILE OFFSHORE PLATFORM

BACKGROUND OF THE INVENTION

This invention generally relates to offshore processing facilities and methods for economically conducting the working of offshore petroleum reserves. More particularly, the invention relates to a mobile offshore platform which has a support structure that rests on the ocean floor and a separate removable barge section that is supported by the structure, permitting the use of various barges with the support structure to provide the functions of exploration drilling, production drilling, production, petrochemical processing, and well servicing to be accomplished as required during the reservoir lifetime.

The need for additional oil, gas and other mineral resources has in recent years brought about increased activity in the exploration for and the recovery of such resources from offshore locations. At locations having substantial oil and gas reserves, the approach taken in recovering the minerals has been to erect a permanent platform at the proposed well site and lay pipelines between the platform and the shore to transport the oil and gas to onshore storage or processing facilities.

In erecting a permanent platform, an understructure is brought to the offshore location by transporting the structure to the well site on floats, or on its own buoyancy. Once the structure is on location, it is made to sink or is lowered to the bottom of the ocean and anchored there by piling driven into the ocean floor. The remaining portion of the permanent platform is erected on top of the understructure, which remaining portion might be a drilling derrick or a production facility, or both. Generally, along with the construction of a permanent platform there will be a simultaneous laying of one or more underwater pipelines to a shore side storage terminal.

The objective of the production platform and the pipeline is to receive the well stream; to separate the well stream into oil, gas, and water; and to transport the oil and gas to the shore terminal. At the shore terminal, the oil is stored and further transported by pipeline or ship to refineries where it can be processed into usable products. The gas is stored and further transported by pipeline to be used as fuel or as feedstocks for petrochemical processing plants. In some cases, the gas is liquefied and further transported by ships to be used as fuel.

In the conventional arrangement described above, to produce a marketable product requires the installation of a production platform, one or more underwater pipelines from the platform to the shore, a shore storage facility for the raw hydrocarbons, a process plant to convert the raw hydrocarbons to a finished product, and a means of transporting the product to market or to the consumer. This arrangement requires a large capital investment, and consequently the offshore hydrocarbon reservoir must be sufficiently large to justify the investment.

In some cases, the reservoir may have sufficient oil reserves to justify commercial production of the oil, and at the same time the gas quantities in the well stream may be insufficient to permit economic recovery of the gas. In such instances, the gas is flared at the oil production platform, or it may be reinjected into the well in an effort to improve the oil flow from the well.

In other cases, where the reservoir contains mostly gas, the size of the reservoir must be very large to permit economic recovery of the gas from offshore locations. Where the initial well stream tests show marginal or insufficient gas quantities present, the gas well will be plugged as noncommercial.

The developments in the last few years regarding the prices of hydrocarbons and the high rates of inflation worldwide have brought about a situation where there is increased demand for hydrocarbons and natural gas in particular, yet the costs of recovering these products have become so great that the size of the economic offshore reservoir has become gigantic. Thus, there is an increasing number of smaller wells which have respectable quantities of gas which cannot be brought to market profitably.

Accordingly, it is desirable to improve the profitability of the small or marginal offshore reservoirs by bringing the petrochemical process plant to the well site rather than bringing the hydrocarbons to the shore side plant. By processing the hydrocarbons at the well site, many of the costs of the traditional arrangement are eliminated. Notable among these are the pipeline costs.

In bringing the process plant to the well site, provisions must be made to accomplish all of the functions required in the production and processing operations involved in converting the well stream products to a usable refined product. These functions include: drilling of production wells to develop the reservoir; completion of the wells; normal production separation of the well stream into oil, gas, and water; petrochemical or mechanical processing of the gas or oil into a usable refined product; storage and handling of the product and fresh water needed in processing; transportation of the product to market; maintenance of the petrochemical plant; and servicing of the wells. Any offshore process facility must provide arrangements to perform all of these necessary functions.

The products which could be produced from an offshore hydrocarbon processing plant include any of the derivations from petroleum. Primary products from gas flow would include: liquid petroleum gas, liquid natural gas, ammonia, urea, and methanol. From oil, the products could include: carbon black, gasoline, naphtha, heating oil, and others.

There are a number of configurations that an offshore hydrocarbon processing plant could take. These include a fixed platform, a floating vessel, and a jack-up type platform.

The fixed platform arrangement would be limited to situations where the reservoir was large enough to amortize the plant investment. This size reservoir may be large enough to produce economically in the traditional manner. The fixed platform would pose problems in maintenance of the process plant, unless it was located close to an industrial area and situated in calm water. Typically, a petrochemical plant operates about 330 days per year and then has a 35 day "turnaround" period where major maintenance work is performed. The work would include renewing of catalysts in reactor vessels, cleaning and repair of heat exchangers, repair and replacement of valves and piping, etc. The turnaround period is one of very high labor intensity to perform the necessary work in the shortest possible time in order to get the plant back into operation. The fixed platform concept would require the turnaround to be accomplished at the offshore site, involving the use of floating derricks to lift the catalyst beds and holders out of the tower type reactors. Because of the close tolerances involved, any motion of the floating derrick would greatly complicate this operation. Also, it would require the presence of a large labor force at the platform, together with all the parts and services needed for a rapid turnaround. Thus, the fixed platform approach is limited to specific applications which would minimize the effects of these problems.

An alternate approach is to utilize a floating vessel as the support for the offshore process plant. This concept provides the mobility which lets the plant be utilized at several successive reservoirs and permits the plant turnaround to be performed at a shore side facility. It has disadvantages in providing the production and completion facilities under some circumstances, and the wave induced vessel motions, however, small, would seriously affect the performance of some petrochemical plant equipment.

The most attractive approach to offshore petrochemical processing plants is the jack-up type platform. The jack-up offers the advantages of both the fixed platform and the ship configurations without the accompanying disadvantages. There are many different jack-up platforms in use today. A typical jack-up platform has a buoyant hull that permits transporting of the platform to the well site and has separate support legs that project upwardly from the hull during transport. Once the platform has reached the desired location, the support legs are lowered into contact with the ocean floor and the platform is jacked up to a level above the surface of the water. Representative of this jack-up platform is Le Tourneau, U.S. Pat. No. 2,830,071. Another approach to jack-up offshore platforms is a multiple stage platform having an upper working platform that is jacked out of the water and a lower support platform functioning as a weight support and as bracing structure. Giblon, U.S. Pat. No. 3,797,265, discloses this type of mobile jack-up offshore platform.

Recently, yet another approach to jack-up drilling and production platforms for offshore gas production has been developed. This approach utilizes a buoyant jacket type support structure which requires no auxiliary buoyancy and is horizontally towable to the well site where it is securely anchored by piles to the ocean floor. A specially shaped barge/desk section outfitted for production is towed to the location after the support structure is anchored and is floated into position proximate the legs of the support structure. The desk section is then lifted clear of the water by jacking mechanisms and secured in place at the operating height. The jacks are then removed for use on another platform. All producing and processing equipment is installed and serviced at the onshore fabrication site before the barge/-deck section leaves the shipyard. A jack-up production platform of this type is available from Raymond International, Inc. and is referred to as a "Tilt-up, Jack-up" platform. One unique feature of this jack-up is an arrangement whereby the production drilling is done through the legs. See Phares, U.S. Pat. No. 3,857,247.

The jack-up platforms in use today are all very suitable for use as exploration drilling vessels or as production platforms, but they are not completely satisfactory for use as a mobile offshore hydrocarbon process platform in that the apparatus must be versatile enough to provide arrangements for all of the functions previously enumerated. A jack-up of the type normally used for drilling presents serious problems involved in plant turnaround and in well servicing. The turnaround must be accomplished at the site or else the complete jack-up, including the legs and support structure, must be removed from the site to the shore industrial area. This would necessitate disruption of the well heads and risers for some plants, and in all instances, the transit time from the site to the shore facility would typically be prohibitively long.

In order to provide for all of the functions at the required site, the need exists for a jack-up platform configuration which would separate the legs and support structure from the operative facility. Thus, the legs and support structure could be put into place first, and then a drilling vessel docked thereon and lifted out of the water. When production drilling and well completion is finished, the structure can be jacked down, and the drilling vessel floated free and removed. Then a petrochemical process plant is floated over the structure and lifted out of the water. For maintenance, the process vessel is refloated and towed at relatively high speed to a shore industrial location. Meanwhile, the support structure could be used to lift a workover barge to perform any necessary well servicing functions. When the reservoir is depleted, the process barge and the legs and support structure can easily be moved to another site.

The Raymond International Tilt-up Jack-up embodies some of the features required of a mobile offshore platform in that it permits the buoyant platform to be separated from the jacket structure. However, it has a fixed jacket rather than a movable leg structure, and it does not provide an easy means to raise any barge which is not specifically configured to mate with the jacket legs. Also, the barge shape which mates with the legs is not necessarily shaped for rapid ocean towing which is required to save time on turnaround periods.

Another approach to offshore production work is a ship platform which utilizes a marine vessel having a process plant assembled on its deck and incorporating portions of a jacking mechanism to raise the ship above the water on support legs engaged by the jacking mechanism. An example of this type of offshore structure for production is the system disclosed by Sumner, U.S. Pat. Nos. 3,716,933 and 3,874,180. A system of the type disclosed in these patents offers certain advantages in mobility over the jack-up platform approach and is more stable than the ship used alone. However, difficulty could be experienced in dismantling the structure for movement to another location due to the fact that the vessel carries the jack holder, which requires that the support legs and structure attached to it be anchored from the ocean floor if the ship is required to be removed from the site. Upon the ship's return, it is necessary to re-anchor the support legs. The requirements of loosening and re-anchoring the structure prohibits the use of the ship until it is desired to move to a new well site.

SUMMARY OF THE INVENTION

In accordance with the instant invention, there is provided a mobile offshore platform for economically producing hydrocarbons obtained from remote offshore reservoirs of limited size. Specifically, the instant invention provides an apparatus which is quickly installable at an offshore well site to process petroleum from a reservoir into a salable product, and which provides rapid dismantling to permit the process plant to be taken ashore for maintenance. Moreover, the instant invention permits the process barge to be constructed and tested in an industrialized location while the legs and support structure can be fabricated at another location, possibly close to the well site. The barge can be towed or self-propelled to the well site safely and at relatively high speed.

For fulfilling the production drilling and well completion functions, the invention readily permits special function barges to be lifted at the well site without moving the legs or disturbing attachments to the sea bed. For process plant maintenance, the barge can be lowered to the water, floated, and then towed or propelled under its own power to the repair location.

In accordance with this invention, there is provided a mobile offshore platform which comprises groupings of elongated support legs adapted to rest on the floor of a body of water with jack mechanisms thereon for raising and lowering a negatively buoyant, open network support structure upon which a barge carrying operational equipment is placed. The groupings of elongated support legs are arranged to define a through passage suitable to accomodate the barge, allowing it to move into position above the platform when it is lowered and to dock upon the support platform when the platform is raised. The jack mechanisms are suitable to raise the combined load of the barge and support platform above the surface of the water to an appropriate level for conducting petroleum producing and processing activity.

The barge has a hull configuration that makes it easily towed or propelled through the water, the hull configuration being of a streamlined rather than an irregular shape. Therefore, when process plant reworking activities are desired to be performed, the barge can be lowered back into the water and quickly brought to an onshore location where the process plant is serviced and brought back to maximum producing capability. The barge can then be returned to the well site and put back into operation quickly, easily and without undue delay and downtime for the process plant.

Installation of this type of offshore petroleum processing facility begins with the support legs and support platform being brought out to the location of the field. During towing, the support legs are raised relative to the support frame which is resting on the deck of a transporting barge, or for mat supported units, it could be floated on the mat. Once the structure is on location, the support legs can be lowered by the jacking mechanisms relative to the support platform structure until they are resting securely on the ocean floor below. The support platform structure is then raised relative to the surface of the water until it no longer rests on the deck of the transporting barge and is totally free therefrom.

After the legs and support structure are in place, the structure can be used to support any of several interchangeable special purpose barges required to ready the site for the process plant. For example, it could be used to support a drilling barge which would drill and complete the production wells. Meanwhile, the barge carrying the process plant is enroute from the onshore shipyard or other place of origin to the well site. When the process plant barge arrives at the well site, the open network support structure is lowered to permit the production drilling barge to be removed and the process plant barge to be floated onto the support platform and docked into position. Once the barge is properly positioned and arranged on the support platform structure, the jacking mechanisms raise the barge to the proper elevation, whereupon the jacking mechanisms may be removed and taken to another location for use there on other platforms of this type.

A heave absorber arranged substantially across the passage between the support legs provides a flexible surface above the surface of the support platform structure for engagement with the bottom of the barge being docked thereon to dampen vertical motion thereof. Suitable fendering and alignment provisions are further provided to permit docking of barges even during periods of unusually large sea waves.

The present invention provides a simple and economic way to bring offshore hydrocarbons to market without using an underwater pipeline. At the same time, it provides a flexible arrangement to permit drilling and well servicing functions to be performed without moving the support structure at the well site. Finally, it provides a highly mobile process platform that enables necessary process plant reworking to be performed onshore rather than at the distant offshore well site location. The delay in installing and bringing on-stream a process plant is significantly reduced by the rapid speed with which the processing barge may be towed to the location, and also due to the ease with which it may be put into service once it arrives at the well site.

These and other aspects of the invention not outlined above will be discussed in the detailed description which follows.

BRIEF DESCRIPTION OF THE DRAWINGS

In order that the invention may be understood in detail, a more particular description of the invention may be had by reference to specific embodiments thereof which are illustrated in the appended drawings and described in the following detailed description.

In the drawings.

DETAILED DESCRIPTION OF THE PREFERRED EMBODIMENT

Figure 1:
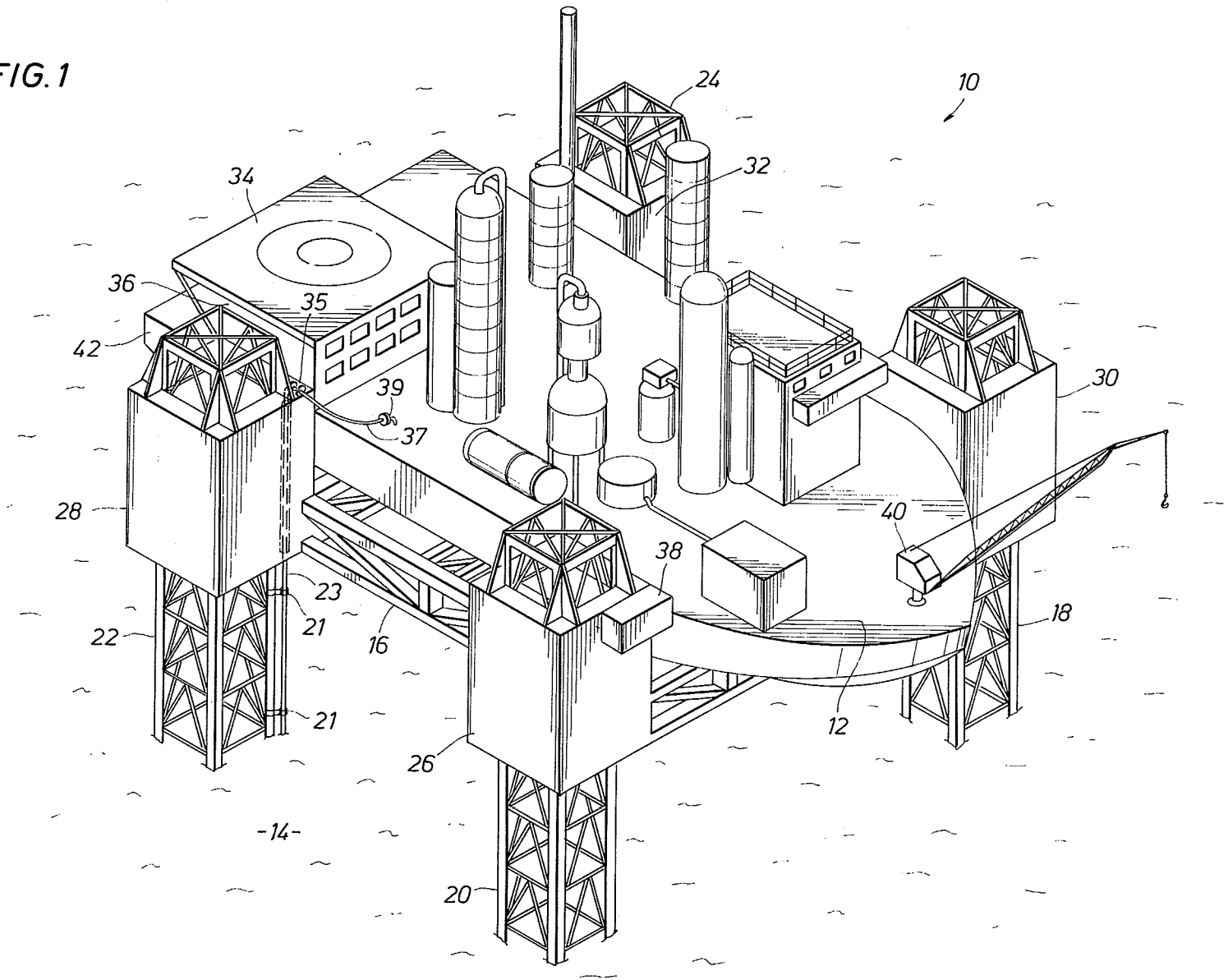
FIG. 1 is a perspective view of the mobile offshore platform of the present invention in place at a well site location, wherein a processing barge is shown resting on the platform structure supported by the support legs extending beneath the surface of the water to the ocean floor below.

Referring first to the perspective view of FIG. 1, one embodiment of a mobile offshore platform in accordance with the instant invention is illustrated and generally indicated by reference numeral 10. The installation includes a boat-shaped proceeding barge 12 having hydrocarbon processing plant equipment mounted thereon. Barge 12 is shown in the elevated position, wherein it is disposed several feet above the surface of the water 14. An open network support platform 16 holds barge 12 above the water with cross trusses 46 (See FIG. 4) providing uniform support for the vessel. The apparatus 10 includes four laterally spaced apart, vertically extending support legs 18, 20, 22 and 24 which are also of an open network construction. A separate jacking mechanism is provided for each support leg, which jacking mechanisms have several jacks each and are suitable for raising support platform 16 with barge 12 positioned thereon above the surface of the water. The jacking mechanisms are secured to the support platform 16 with two jacking mechanisms 30, 32 being positioned on the port side and jacking mechanisms 26, 28 being on the starboard side. A master control station 38 is shown on jacking mechanism 26 and carries a removable power unit that is capable of powering all jacks in the jacking mechanisms. Although the apparatus 10 is shown as having four support legs, it will be understood that the apparatus might be provided with any number required to stably support the barge.

The hydrocarbon processing equipment mounted on barge 12 could include, for example, water storage tanks, vessels, towers, exhaust stacks, heat exchangers, process pumps and the like. In addition to the processing equipment, there is provided a helicopter pad 34 which is shown mounted atop the crew quarters building 36. Additional equipment such as a crane 40 can also be added to the deck of barge 12 as needed.

From the perspective view of FIG. 1, the boat-like shape of barge 12 is apparent. Barge 12, while having a conventional stern portion 42 that is substantially squared off, has a pointed or streamlined bow that permits rapid movement through the water to increase towing speed and cut down on delay in getting to and from the well site. Further, the configuration of barge 12 is not dictated by a required mating of the support legs and the barge structure, such as is the Raymond International Tilt-up Jack-up production platform and other similar platforms. Therefore, the irregular shape which other barge/deck structures must take on in order to be compatible with their support structure is not necessitated by the approach to offshore gas proceeding installations presented by the present invention.

The support legs 18, 20, 22 and 24 are shown as being of a square or rectangular cross-sectional configuration constructed in an open network, cross-bracing type of construction. The support legs could, however, be designed in other cross-sectional configurations such as cylindrical, hexagonal, and possibly in the shape of a triangle. Also, the legs could have a solid outer shell rather than the open network of cross-bracing as shown.

Further, shown in FIG. 1 is one arrangement for the rise flow pipe 23 that extends from the underwater manifold at the well head to the surface vessel, barge 12. Due to the jack-up function that must be performed to raise barge 12, and further due to settling of the support legs into the sea floor, it is necessary to attach the riser 23 to the offshore platform structure in a manner so as to permit movement of barge 12 and the support legs relative to it.

In the embodiment illustrated in FIG. 1, the riser flow pipe 23 extends upwardly parallel to leg 22. Support clamps 21 having an internal cross-section slightly larger than the cross-section of the riser 23 are attached to the leg as shown. The riser 23 passes through the clamps 21 and through a pipe sleeve formed in jack house 28 associated with leg 22. In this arrangement, the riser flow pipe is supported by leg 22 with freedom to move laterally with the leg 22 being free to move vertically and settle with time without putting a load on the riser. Further, platform 16 can be jacked up and down without interfering with the riser, and the jack house can provide protection against damage to the riser.

The riser 23 terminates at its upper end with a shutoff valve and hose connector 35. A short piece of flexible hose 37 extends from riser 23 to a connector 39 on barge 12. When barge 12 is to be lowered, the flexible hose 37 is disconnected at connector 39 after the shut-off valve is turned off.

Figure 2:
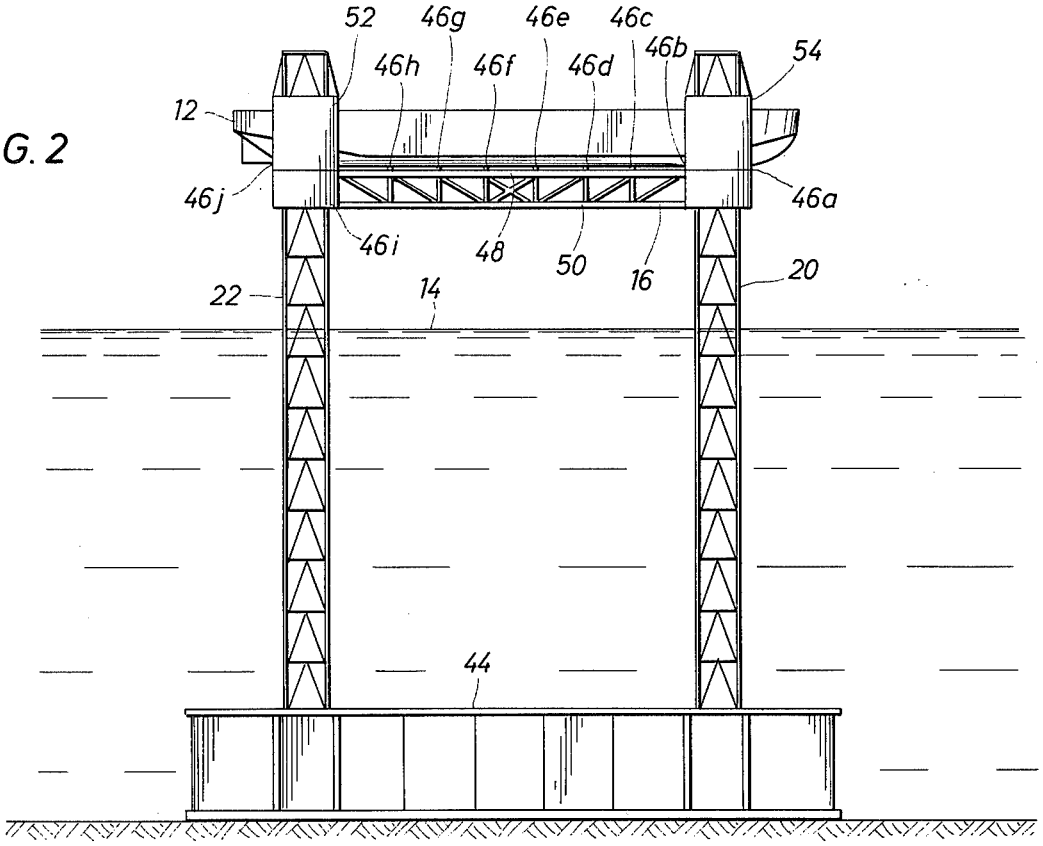
FIG. 2 is a side elevation view of the process barge resting on the platform structure supported by a storage mat.
Figure 3:
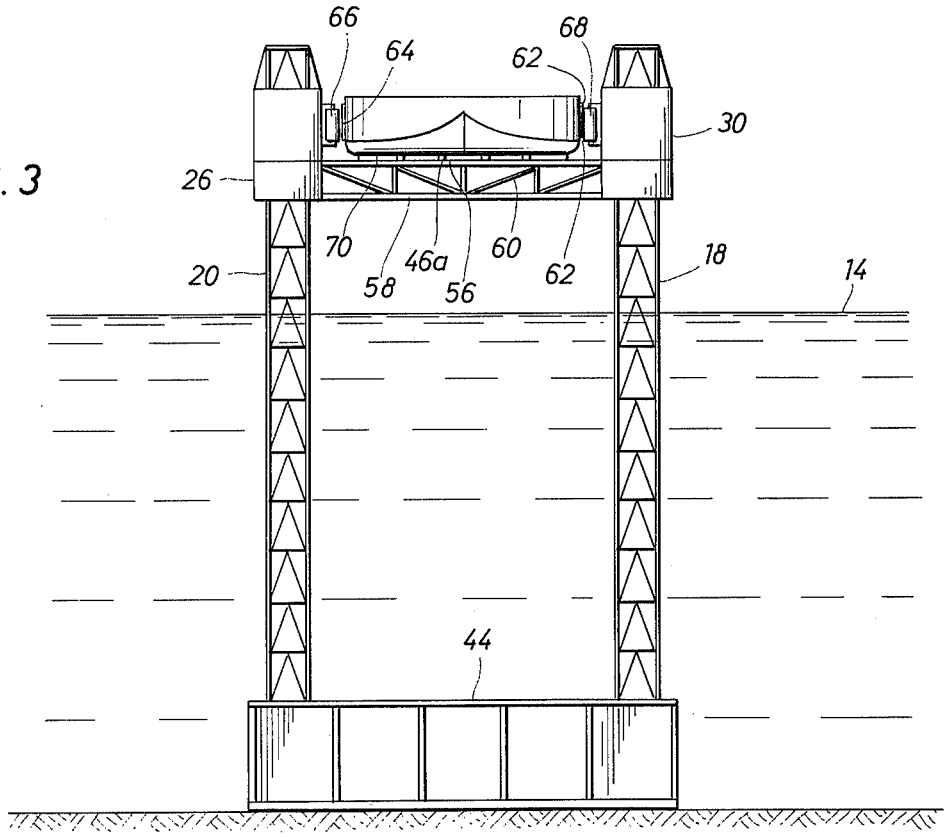
FIG. 3 is a frontal view of the barge and platform structure of FIG. 1.

Referring now to FIGS. 2 and 3, additional details of the support platform and the support legs, as well as the position of barge 12 on platform 16 may be had. From the views of FIGS. 2 and 3, it will be apparant that the combined structure of the support platform 16 and the support legs 18, 20, 22 and 24 have a negative buoyancy. As shown in FIG. 2, the support legs extend down to and attach to a storage mat structure 44 which rests on the ocean floor. If the mat structure 44 is not desired to be used, spud cans can be used to firmly secure the support legs to the ocean floor. Less desirable, but also a possible means of securing the legs to the floor, are piles which require associated pile guide and pile driving equipment added to the support legs. Additional details of the mat structure 44 may be had by reference to FIG. 5.

Figure 4:
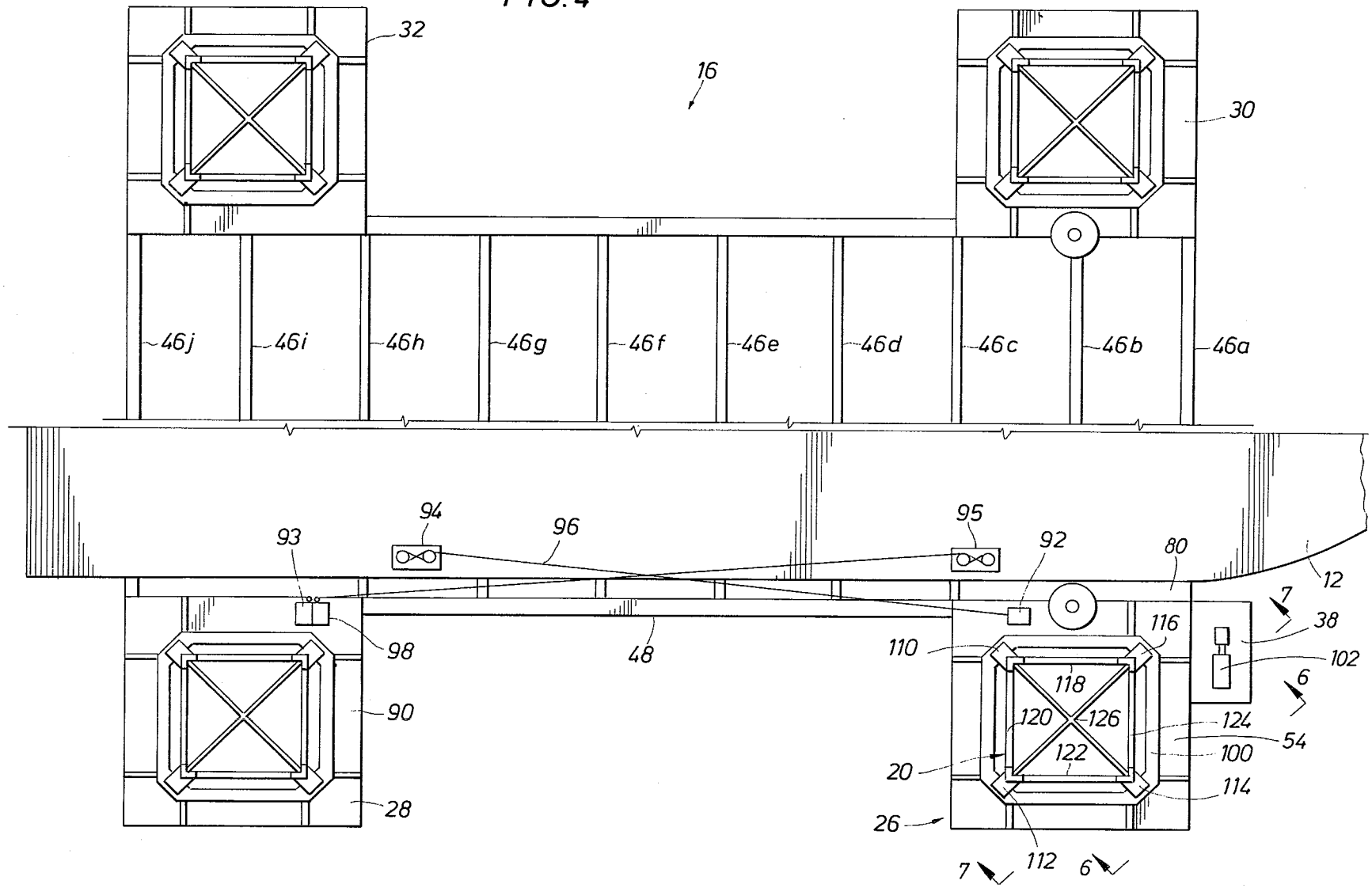
FIG. 4 is a plan view of the platform support structure that shows details of the positioning and jacking mechanisms utilized.

From the side view of FIG. 2 and the plan view of FIG. 4, the spaced arrangement of the transversely extending truss members **46*a*–46*j* is evident. The multiple cross trusses provide uniform support to barge 12 and are preferably aligned with the structural members internal to the hull of barge 12. Also, revealed from the side view of FIG. 2 is the hull configuration of barge 12.** The stern of the barge hull rises upwardly with the bow also being upwardly turning, thereby minimizing drag as the vessel is towed or otherwise moved through the water.

As well as the transversely extending trusses, best seen in FIG. 4, the support platform 16 also comprises an upper side runner 48 and a lower side runner 50, which runners are interconnected by bracing of an open lattice work construction. The jacking mechanisms which include a jack house structure, such as 52 and 54, attach to upper and lower side runners 48 and 50. The jack houses 52 and 54, as well as those accociated with the other support legs, are disposed about their respective support legs and move relative to the support legs and, of course, relative to the surface of the water.

The frontal view of the mobile offshore platform illustrated in FIG. 3 further shows the use of an open network type of construction for the transversely extending trusses, of which truss **46*a* is in view. Similar to the side runners used along each side of support platform 16, the transversely extending trusses also have an upper and a lower brace member. Transverse truss member 46*a* has, for example, upper brace 56 and lower brace 58 along with associated interconnecting lattice work bracing generally designated by the reference numeral 60.**

Also evident from the view in FIG. 3 is the contoured underside of the hull of barge 12. Attached to the sides of barge 12 are fenders 62 and 64 which serve as shock absorbers during the docking of barge 12 in the support platform 16. Support platform 16 also includes fenders 66 and 68 mounted to the inside of the forward jack houses to aid in the docking of barge 12. Distributed across the top of the transversely extending trusses **46*a*–46*j* are docking blocks 70 which provide a cushion between the hull of barge 12** and the transverse trusses.

Referring now to FIG. 4, the ladder-like construction of platform 16 comprising the transversely extending trusses **46*a*–46*j* can be better unerstood. Further with respect to this view, the arrangement of the jacking mechaniams 26, 28, 30, 32 on support platform 16** is also more ascertainable.

The foreward, starboard jacking mechanism 26 is shown in slightly greater detail in FIG. 4 in that there is also illustrated the jacking frame 100 which mounts on and extends from the top of jack house 54 and is disposed about support leg 20. Jacking frame 100 is shown to be substantially square in configuration; however, it is to be understood that the shape would necessarily change if the shape of support leg 20 were altered. A jack system power plant 102 shown associated with the jacking mechanism for the forward, starboard support leg is positioned adjacent the jacking frame and supplies power to all jacks. Additional details by way of cross-sectional cutaway views of the jacking mechanism 26 are given in FIGS. 6 and 7 which as indicated from the sectioning lines will present a view from the outermost forward corner of jack house 54 and jacking frame 100.

Figure 5:
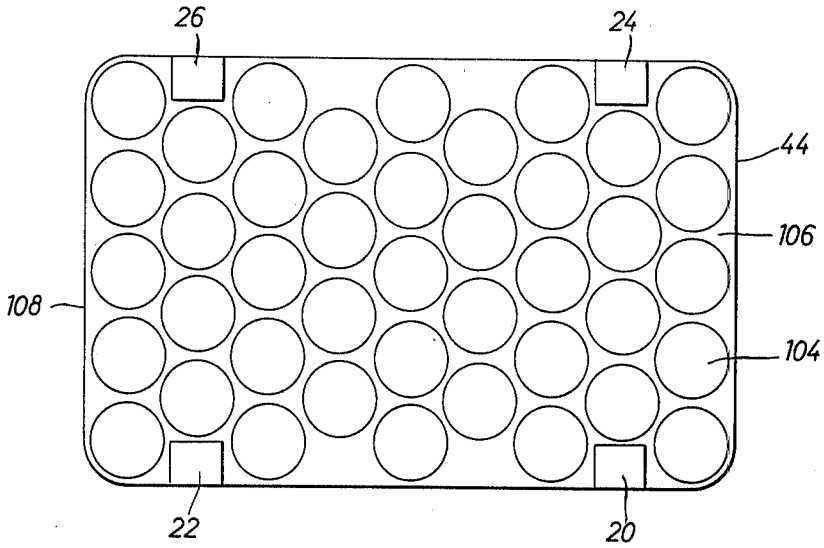
FIG. 5 is a plan view of a storage mat structure which rests on the ocean floor and has attached to it the support legs.

FIG. 5 presents a plan view of the mat 44 upon which the support legs mount and attach. Mat 44 is a rectangularly shaped structure having a plurality of chamber 104 which can be used for storage of hydrocarbons or processed product. The end portions 106 and 108 of mat 44 extend beyond the positions of the support legs. The width of mat 44, as shown, corresponds to the lateral spacing of the support legs with no overhang on the sides; however, the mat can be of a greater width.

Referring briefly to FIG. 4 along with FIG. 5, it will be understood that the support platform 16 is centrally placed over mat 44 in view of the fact that the jacking mechanisms and support legs are disposed outside the outer perimeter of support platform 16, whereas the support legs are disposed inside the outer perimeter of the mat structure 44. As previously mentioned, mat structure 44 is optional.

Each support leg includes a bracing structure and four leg chords disposed at the corners of the bracing structure. Referring once again to FIG. 4, support leg 20 is observed to comprise four vertically extending leg chords 110, 112, 114 and 116 interconnected by a plurality of leg bracing members of which 118, 120, 122 and 124 form only one group of such bracing members. In addition, cross-bracing 126 extends diagonally across between opposing corners to further add strength to the support leg structure.

Figure 6:
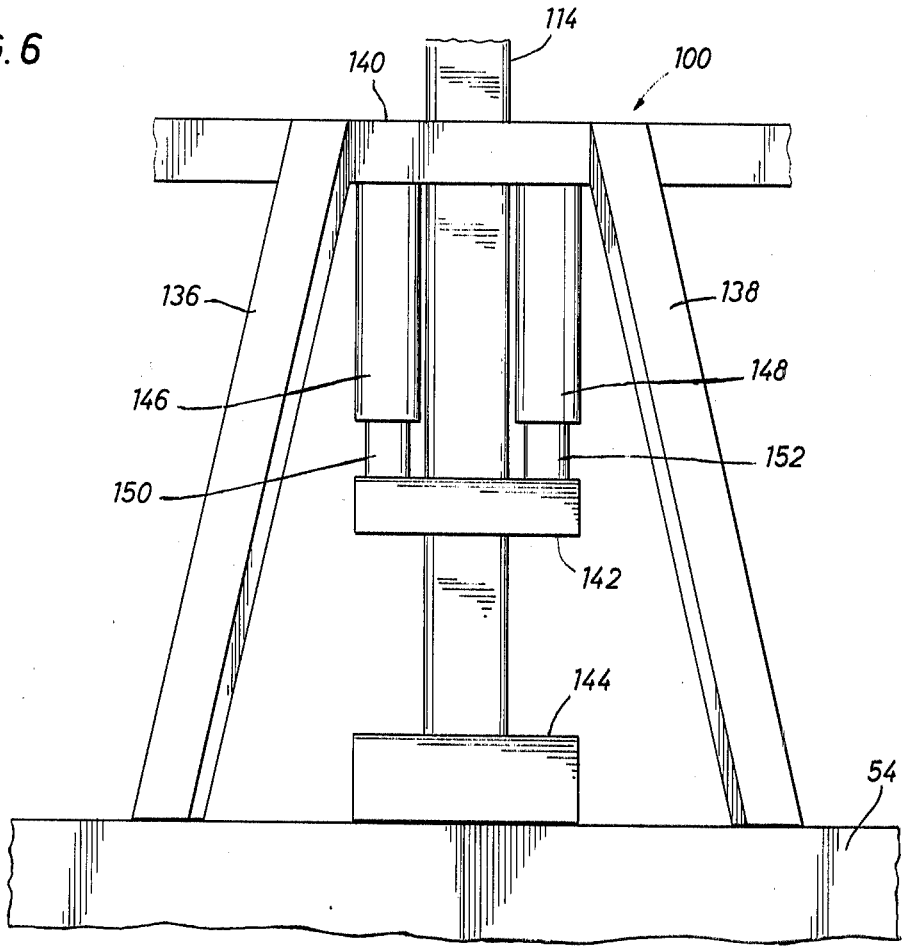
FIG. 6 is a corner view of the jacking mechanism illustrated in the plan view of FIG. 4.

Referring to FIG. 6, leg chord 114 and the associated jacking equipment for the forward, outermost starboard corner of jacking frame 100 and jack house 54 is presented. The arrangement for the other three corners of support leg 20 is identical to that illustrated in FIG. 6. Leg chord 114 is shown to be engaged by the jacking equipment supported from jacking frame 100 which includes corner supports 136 and 138. Corner supports 136 and 138 extend between the top of jackhouse 54 and an upper frame member 140 that extends around the periphery of the jacking frame 100 as best seen from the plan view in FIG. 4. Leg chord 114 extends through the upper frame member 140 of jacking frame 100 and is engaged by jacking pawls that are disposed within jacking pawl house 142 and further enaged by locking pawls disposed within locking pawl house 144. Hydraulic jacks 146 and 148 are secured to upper frame member 140 and extend downwardly parallel to leg chord 114 with jacking pawl house 142 attached to the hydraulic rams 150, 152 of the hydraulic jacks.

An identical arrangement of hydraulic jacks, jacking pawl house and locking pawl house is presented at each of the remaining three corners of support leg 20. The hydraulic jacks disposed at each of the four corners of support leg 20 are coordinated and operated simultaneously to provide uniform lifting of the load supported by support leg 20.

Figure 7:
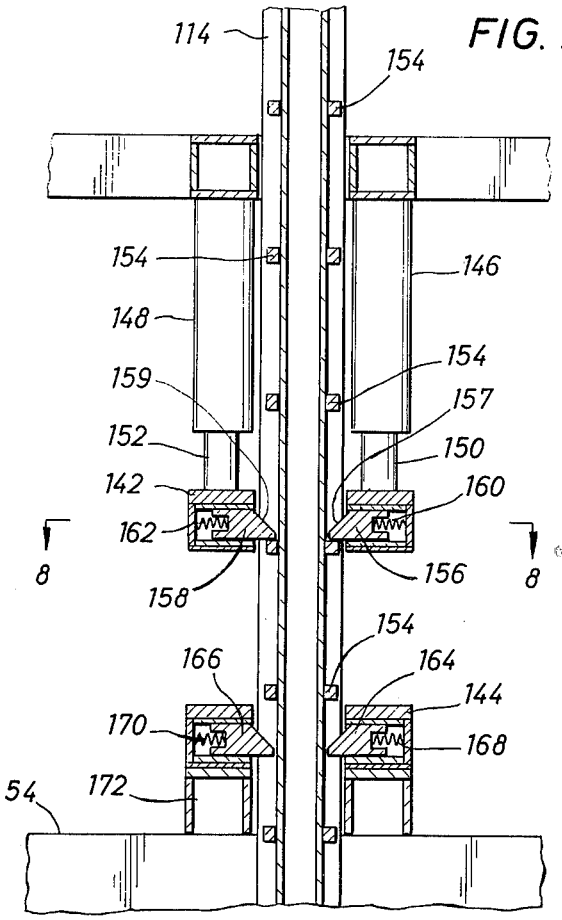
FIG. 7 is a cross-sectional view of a portion of the jacking mechanism illustrated in FIG. 6.

Referring next to FIG. 7, the internal details of the jacking equipmemt shown in the FIG. 6 are illustrated presenting a more complete understanding of the construction and design details utilized therein. Leg chord 114 includes a plurality of jacking blocks 154 disposed along its length at spaced locations. The jacking blocks 154 are spaced to provide defined steps setting the distance of each increment of movement in the jacking process. The jacking blocks 154 attach to the web portion of the I-shaped leg chord (see FIG. 8).

Jacking pawl house 142 encloses jacking pawls 156 and 158 which are slidable therein and spring loaded. Pawl 156 is urged outwardly from jacking pawl house 142 by a spring 160, and jacking pawl 158 is similarly urged from within jacking pawl house 142 by a spring 162. Jacking pawls 156 and 158 are of a generally rectangular shape except for an upwardly and outwardly beveled portion 157 on pawl 156 and a similar portion 159 on pawl 158. As previously mentioned in the discussion of the hydraulic jacking system, jacking pawl house 142 is coupled to the lower end of hydraulic rams which move the jacking pawl house relative to leg chord 114. Upon encountering a jacking block, pawls 156 and 158 are pushed against their respective springs, moving back into the recessed area of jacking pawl house 142 until the jacking block is passed whereupon the jacking pawls 156 and 158 are again urged out from within jacking pawl house 142.

Locking pawl house 144 mounted atop jack house 54 encloses locking pawls 164 and 166 which are similar to the jacking pawls 156 and 158. Springs 168 and 170 urge pawls 164 and 166, respectively, out from within the enclosure formed by locking pawl house 144. Upwardly and outwardly beveled portions are also formed on the forward ends of locking pawls 164 and 166, permitting them to move over jacking blocks that are encountered. Locking pawl house 144 is mounted atop jack house 54 by a support structure 172 which positions the locking pawls a small distance above the top of jack house 54.

Figure 8:
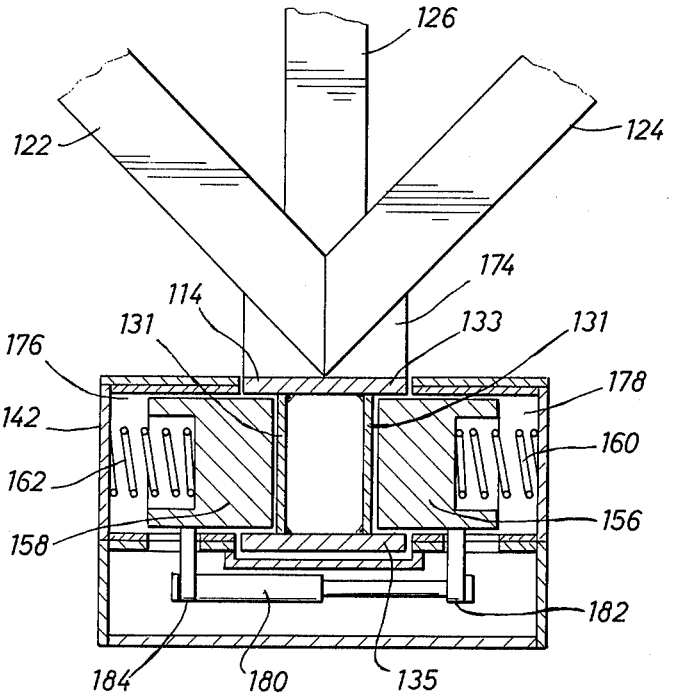
FIG. 8 is a plan cross-sectional view of the jacking mechanism shown in FIGS. 6 and 7.

From the detailed cross-sectional plan view of FIG. 8, further details of the jacking system of FIG. 6 and 7 may be had, as well as details of leg chord 114 and its mounting to leg braces 122 and 124. Specifically, leg chord 144 is of an I-shaped construction having two flange plates 133 and 135 interconnected by two web plates 131. Plate 133 of leg chord 114 mounts to the corner of support leg 20 shown by a mounting plate 174. As shown, jacking pawls 156 and 158 are of a width which permits them to fit between the flange plates 133 and 135 of leg chord 114 and into abutment with opposing sides of web 131.

Jacking pawl house 142 not only forms separate recessed channels 176 and 178 for the jacking pawls, but also forms an enclosure around pawl retract piston 180. Pawl retract piston 180 interconnects between an ear 182 attached to pawl 156 and an ear 184 attached to pawl 158. Pawl retract piston 180 is a small hydraulic cylinder and ram mechanism suitable for urging jacking pawls 156 and 158 against their respective springs and back into the recessed areas 176, 178 of jacking pawl house 142. Pawl retract piston 180 is used during support platform lowering operations as will be more fully described hereinafter.

Referring now to FIGS. 6, 7 and 8, it will be apparent that during a platform lifting operation, wherein support platform 16 is moved relative to the support legs, that the lifting process will be carried out in incremental steps as defined by the jacking blocks. Using support leg 20 and jacking mechanism 26 as being representative, in raising support platform 16, jacking pawl house 142 will be urged upwardly relative to leg chord 114 by hydraulic jacks 146 and 148. Jacking pawls 156 and 158 will be protruding from the recessed portions of jacking pawl house 142 and will be moved along in contact with the web portion 131 of leg chord 114. Upon encountering a jacking block 154, jacking pawls 156 and 158 will be pushed inwardly due to their beveled end portions; and once they have passed over the jacking block, they will again be urged by their respective springs out from within the recessed portions of jacking pawl house 142 and assume their previous position in contact with the web portion 131. The hydraulic jacks are then pressurized to begin pushing downwardly on jacking pawl house 142 which, of course, urges the jack house and attached platform upwardly relative to leg chord 114. The lifting force provided by the hydraulic jacks is applied through the jacking pawls to the jacking blocks attached to leg chord 114.

As support platform 16 is being raised, the locking pawls 164 and 166 are being moved toward another jacking block. As the locking pawls move into contact with the jacking block, the locking pawls are urged against their respective loading springs back into the recessed portion of locking pawl house 144 in a similar manner as jacking pawls 156 and 158. After moving over the jacking block encountered, the locking pawls are again urged into contact with the web portion of leg chord 144. Once locking pawls 164 and 166 are into position above the jacking block encountered, the hydraulic jacks are reversed to again begin pulling the jacking pawl house upwardly toward another jacking block. The weight of the platform is then supported on locking pawls 164 and 166. Coordinated effort between jacking pawls 156, 158 and locking pawls 164, 166 provides a ratchet type operation that moves the support platform 16 incremental distances with each ratchet operation.

When it is desired to lower support platform 16, jacking pawls 156 and 158 engage a jacking block and the hydraulic jacks 146 and 148 raise the jack house slightly to permit locking pawls 164 and 166 to be retracted from engagement with a jacking block. A retract piston similar to the retract piston 180 that operates jacking pawls 156 and 158 operates to urge the locking pawls into the recessed portions of locking pawl house 144. With the locking pawls so released, the hydraulic jacks which have their hydraulic rams 150, 152 fully extended, begin lowering the structure with the hydraulic rams being allowed to move it back into the hydraulic jack cylinder. When the hydraulic rams have been retracted their full travel distance or a convenient jacking block is available for locking pawls 164 and 166 to engage, the locking pawls are reset to support the structure. Pawl retract piston 180 releases jacking pawls 156 and 158 to permit the hydraulic rams to be extended from the hydraulic jacks down to the next jacking block. The above recited procedure is repeated the required number of times necessary to lower the structure incrementally down leg chord 114.

Figure 9:
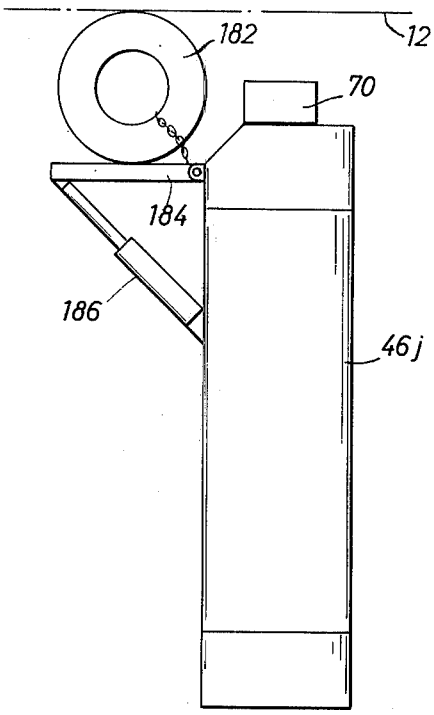
FIG. 9 is an elevation view of a shock absorbing and damping mechanism for use in assisting the docking of the processing barge with the platform support structure.

Referring again to FIG. 4 and also to FIG. 9, the mooring and docking equipment briefly mentioned in regard to FIG. 3 is shown in more detail.

Docking assistance is received from the "doughnut" absorber mechanism illustrated in FIG. 9. The doughnut heave absorber 182 is disposed across the opening between the legs of support platform 16 through which barge 12 enters, and is secured to the last transverse truss **46*j* by mounting platform 184. Doughnut heave absorber 182 is made of a pliable material to serve as a horizontal fender to dampen vertical motions of the barge. Typically a series of doughnut shaped fenders will be employed. The fenders are supported on and attached to a platform 184 which is hinged with truss 46*j*. A hydraulic jack 186 may be provided to move platform 184 from the horizontal position shown in which the upper surface of the doughnut is above docking blocks 70, to a downwardly inclined position. In its upper position, the upper surface of the doughnut is sufficiently close to the water level that the barge will first engage the doughnut substantially across the width of the barge as it approaches the opening between the legs of platform 16. In its lower position, the doughnut is out of contact with the barge supported on docking blocks 70. As the processing barge 12 is being docked with support platform 16, the bottom of barge 12 is brought into contact with heave absorber 182 which dampens heaving motion of the barge. Doughnut heave absorbers 182 are shaped much like a cylinder and may extend across substantially the entire width of support platform 16** or be selectively positiond across the width.

When barge 12 is fully docked, it rests on docking blocks 70 that are secured across the transverse trusses. With barge 12 in the docked position, heave absorber 182 will be substantially compressed. The platform jack 186 is operable to lower platform 184 so that the pressure on heave absorber 182 can be relieved, preventing it from being subjected to a constant and severe strain that would destroy it.

With reference again to FIG. 4, in order to slowly and controllably bring barge 12 into position on support platform 16, mooring lines 96, 97 are attached between the deck of barge 12 and mooring winches 92, 93 mounted atop the front and rear jack houses. The starboard mooring line 96 is seen in FIG. 4 to extend from the front mooring winch 92 to a mooring bitt 94 mounted on the deck of barge 12. Similarly, a mooring line 97 extends from the aft winch 93 to the mooring bitt 95. A similar arrangement exists for the post side docking and mooring equipment. The mooring lines on the port and starboard side of the barge are connected to the mooring winches when the barge 12 is brought into close proximity to the support platform 16 in preparation for docking of the barge 12 on the platform. The winches are utilized to slowly and controllably bring the barge 12 between the upwardly extending support legs and properly position barge 12 on support platform 16.

Installation of the mobile offshore platform 10 begins with the bringing of the negative buoyancy platform structure 16 to the offshore well site location. The structure is brought on some type of a floating vessel, preferably a barge having a large flat deck surface. To facilitate towing, the support legs 18, 20, 22 and 24 are raised to their uppermost position such that they project upwardly relative to the deck level of the transporting barge. Once the negative buoyancy support structure arrives at the well site, the support legs are placed into contact with the ocean floor by lowering the support legs into the water relative to the platform structure. The jacking mechanisms are used to lower the support legs and do so in the manner previously discussed regarding the operation of the jacking mechanisms. The support legs are lowered down to the ocean floor where they are secured to a mat structure or, in the alternative, secured by spud cans. When all support legs are standing on the bottom, the platform structure 16 may be removed from the transport barge by jacking up the platform structure 16 on the support legs and taking away the transport barge.

The barge 12 having, for example, a process plant on deck is brought to the well site location on its own buoyancy by towing or other means of propelling the barge. Upon reaching the well site, the processing barge is aligned with the through passage defined by the support legs, and the port and starboard mooring lines are connected between the platform structure and the processing barge. The platform structure 16, of course, has been lowered on the support legs to a position wherein it is sufficiently beneath the surface of the water to permit the barge to be floated over the platform structure. The barge 12 is then docked on the platform structure 16 by first engaging the barge with the heave absorbing means 182 to dampen the vertical movement of the barge by wave action. It will be noted the upper portion of doughnut 182 extends above the levels of docking blocks 70. Optionally the barge may be provided with interior ballast tanks in order to dispose the barge in a "bow up" position as it engages the heave absorber. Ballasting adjustment would then be used to float the barge over the support structure. The winch driven mooring lines pull the barge onto the platform structure between the upwardly extending support legs. Fenders mounted to the inside surfaces of the jack houses, as well as the fenders attached to the outside of the barge hull, provide a cushioning effect preventing damage to either the barge or the platform structure when wave action causes the barge to move laterally. Once the barge is in proper position on the platform structure, the platform structure and the barge are raised above the surface of the water to the proper level for carrying out the desired operations.

When it becomes necessary to rework the process plant or perform other major maintenance on the vessel or process plant, the barge is lowered back into the water by lowering the platform structure on the support legs. The processing barge is released from platform structure 16 and pulled out from within the through passage defined by the upwardly extending support legs. The processing barge may then be taken to an onshore maintenance facility or shipyard.

Due to the streamlined configuration of the hull of the processing barge, the barge is quickly taken to and brought back from the maintenance facilities. Since the process plant is easily taken ashore, the reworking of the plant is expedited, and saves the great expense associated with the bringing in and lodging of the required technical personnel necessary to rework a fixed offshore process plant.

Numerous variations and modifications may obviously be made in the structure herein described without departing from the present invention. Accordingly, it should be understood that the embodiments herein described and shown in the figures of the accompanying drawings are illustrated only and are not intended to limit the scope of the invention. For example, although the process barge is described as a towed vessel, it may be self-propelled. As indicated above, the barge may be provided with ballast tanks which may be selectively deballasted to orient the barge in a bow-up or level position during docking. Other jacking mechanisms other than shown may be employed. The fenders and movement absorbing means may also be of various design as is known in the art. Accordingly, it will be understood that variations of this nature may be undertaken without departing from this invention.

What is claimed is:

1. An offshore platform structure comprising:

a negatively buoyant one-piece platform defining a substantially horizontal support surface for accepting a vessel thereon;

a plurality of support legs on said platform being supported by the sea bottom below the surface of the water for stably supporting said platform, said legs being spaced to define a passage between said legs;

a plurality of jacking mechanisms secured to said platform and adapted to engage said legs for raising and lowering said platform with respect to said legs to position said platform above water level or below water level;

heave absorbing means disposed substantially across the passage between said legs, said heave absorbing means comprising a fender of pliable material providing a flexible surface extending above said support surface for engagement with the bottom of the vessel to dampen vertical motion thereof during docking and means for moving said fender between a first position wherein said fender is raised above the surface of the support surface to a second position wherein said fender is below the surface of the support surface; and a substantially flat-bottomed work barge to be floated over said platform through said passage and to be supported without attachment on said platform at a raised position above water level.

2. The structure of claim 1 including:

means to selectively mount and demount said jacking mechanisms relative to said legs.

3. The structure of claim 1 wherein:

said platform comprises a plurality of open network of trusslike members arranged between said legs transversely to said passage.

4. The structure of claim 1 including:

a mechanism for locking said negatively buoyant platform in place on said supports, permitting jacking equipment comprising said jacking mechanisms to be removed.

5. The structure of claim 1 wherein:

said jacking mechanisms each comprise a plurality of jacks powered from a common power plant.

6. The structure of claim 1 including:

a mat structure resting on the sea bottom to which said support legs are secured.

7. The structure of claim 1 including:

a plurality of clamps disposed along one of said support legs for supporting a riser flow pipe extending from an underwater well head to said work barge, said clamps having an internal cross section of the riser pipe to permit movement of said support legs relative to the riser to prevent loading thereof.

8. The structure of claim 7 including:

a disconnectable coupling disposed between said work barge and a riser connected to an underwater well head to facilitate removal of said barge from the well site.

* * * * *

UNITED STATES PATENT OFFICE

CERTIFICATE OF CORRECTION

PATENT NO. : 4,040,265

DATED : August 9, 1977

INVENTOR(S) : Lance W. Hellerman, et al.

It is certified that error appears in the above-identified patent and that said Letters Patent are hereby corrected as shown below:

Col. 10, Lines 60-61, "leg chord 144" should read --leg chord 114--

Col. 11, Lines 46-47, "leg chord 144" should read --leg chord 114--

Col. 15, Line 8, "having an internal cross section of the" should read --having an internal cross section slightly larger than the cross section of the--

Signed and Sealed this

*Nineteenth* Day of *December 1978*

[SEAL]

*Attest:*

RUTH C. MASON
*Attesting Officer*

DONALD W. BANNER
*Commissioner of Patents and Trademarks*